US005696876A

United States Patent [19]

Lee

[11] Patent Number: 5,696,876

[45] Date of Patent: Dec. 9, 1997

[54] HIGH-SPEED BIT ASSIGNMENT METHOD FOR AN AUDIO SIGNAL

[75] Inventor: Myung-Su Lee, Kyonggi-Do, Rep. of Korea

[73] Assignee: Hyundai Electronics Industries Co., Ltd., Rep. of Korea

[21] Appl. No.: 363,356

[22] Filed: Dec. 23, 1994

[30] Foreign Application Priority Data

Dec. 29, 1993 [KR] Rep. of Korea ..... 93-30523

[51] Int. Cl.[6] ..... G10L 7/06

[52] U.S. Cl. ..... 395/2.38; 375/240

[58] Field of Search ..... 395/2, 2.1, 2.14, 395/2.38, 2.39, 2.35, 2.36; 375/240, 241; 370/83, 118

[56] References Cited

U.S. PATENT DOCUMENTS

| | | | |
|---|---|---|---|
| 4,516,258 | 5/1985 | Ching et al. | 395/2.38 |
| 4,890,316 | 12/1989 | Walsh et al. | 379/98 |
| 5,367,608 | 11/1994 | Veldhuis et al. | 395/2.38 |
| 5,469,474 | 11/1995 | Kitabatake | 375/240 |

*Primary Examiner*—Benedict V. Safourek

*Attorney, Agent, or Firm*—David M. Klein; Bryan Cave LLP

[57] ABSTRACT

A high-speed bit assignment method for audio signal is disclosed. The Method is usable by various systems using encoding and decoding, capable of reducing bit assignment time in a compressing method using a psychological acoustic model, increasing a bit assignment ratio by using a maximum possible bit, and facilitating high-speed processing. The present invention includes a first step which obtains a total assignment possible bit number available to bit assignment of each channel using a signal-to-noise ratio from a psychological acoustic model and obtains an effective assignment bit number assigning the total assignment possible bit number to a sub-band of one channel in response to a sub-band of a multi-channel; a second step which compares the total assignment possible bit number and the effective assignment bit number from the first step; and a third step which obtains a second effective assignment bit number when the effective assignment bit number from the first step is larger than the total assignment possible bit number, whereby when the high efficiency of the bit assignment is increased and when the support data region of the variable length is used, 100% of the total bit number needed to produce the bit stream of one frame is available, so that high speed processing can be secured.

15 Claims, 3 Drawing Sheets

HIGH-SPEED BIT ASSIGNMENT METHOD FOR AN AUDIO SIGNAL

BACKGROUND OF THE INVENTION

1. Field of the Invention

The present invention relates to a high-speed bit assignment method for audio signals, and in particular to a high-speed bit assignment method for audio signals, applicable to various systems using encoding and decoding, capable of reducing bit assignment time in a compressing method using a psychological acoustic model, increasing a bit assignment ratio by using a maximum possible bit, and facilitating high-speed processing.

2. Description of the Conventional Art

Conventionally, an audio signal bit assignment method for a transmitting system, which transmits encoded audio signals from a broadcasting station to a receiving system which receives and decodes the audio signals, is performed by assigning the bits the same weight in response to each channel. Thus, a lot of bits are assigned to a channel which needs only a small number of bits, and a small number of bits are assigned to a channel which needs a lot of bits, so that it is impossible to secure the same audio quality and to use the possible total bit number. Thus, the high speed processing thereof can not be secured due to repeating computation for a mask-to-noise ratio MNR and duplicated loops and computations.

SUMMARY OF THE INVENTION

Accordingly, it is an object of the present invention to provide to a high-speed bit assignment method for audio signals, applicable to various systems using encoding and decoding, capable of reducing a bit assignment time in a compressing method using a psychological acoustic model, increasing a bit assignment ratio by using a maximum possible bit, and facilitating a high-speed processing.

It is another object of the present invention to provide a high-speed bit assignment method of audio signals capable for using a computing method of computing an assignment bit number by obtaining each mask-to-noise ratio by recognizing the entire sub-band as one channel without dividing the channel therefrom, so that the weights are increased at each of the sub-bands and more bits can be secured to the bands which need more bits, thereby preventing time delay which is caused by the loop as much as the number of the sub-band per channel for obtaining the assignment bit number of the conventional one sub-band.

It is a further object of the present invention to provide a high-speed bit assignment method for audio signals capable of increasing the bit assignment efficiency. Moreover, when support data of variable length is used, 100% of the total bit number which is used for a bit stream of one frame can be secured.

To achieve these objects, the present invention includes a first step which obtains a total assignment possible bit number available to bit assignment of each channel using a signal-to-noise ratio from a psychological acoustic model and obtains an effective assignment bit number assigning the total possible bit number to a sub-band of one channel in response to a sub-band of a multi-channel; a second step which compares the total assignment possible bit number and the effective assignment bit number from the first step; and a third step which obtains a second effective assignment bit number when the effective assignment bit number from the first step is larger than the total assignment possible bit number.

DESCRIPTION OF THE PREFERRED EMBODIMENTS

Figure 1:
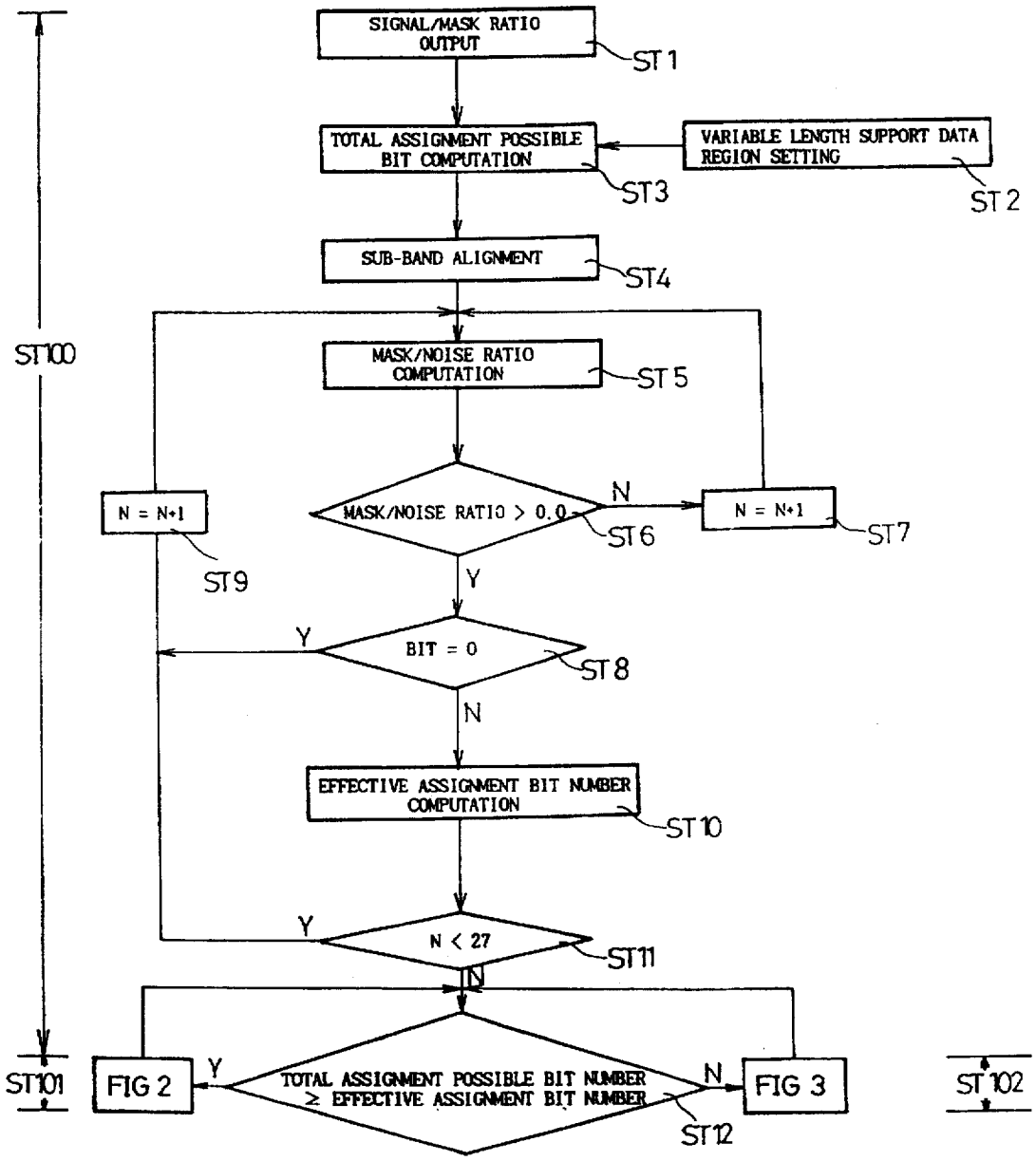
FIG. 1 is a flow chart showing effective assignment bit number processing for obtaining an effective assignment bit number according to the present invention.

Referring to FIG. 1, the present invention includes a first step ST1 for outputting a signal-to-mask ratio through a psychological acoustic model; a second step ST2 for setting a variable length support data region in order to effectively use the total bits without decreasing the original function of the support data; a third step ST3 for computing the total assignment possible bit number using the output value of the signal-to-mask obtained from the first step ST1 and the previously set variable support data region; a fourth step ST4 for limiting the performing number by the sub-band number of a channel by virtually adding the same sub-band in the sub-bands of each of the channels in response to the various type of multi-channel mode after the total assignment possible bit number; a fifth step ST5 for obtaining a mask-to-noise ratio using a signal-to-noise SNR; a sixth step ST6 for checking whether or not the mask-to-noise is larger than zero; a seventh step ST7 for repeatedly performing steps after the fourth step ST4 by increasing the index bit BIT having information with respect to the bit number assigned to one sub-band when the mask-to-noise is smaller than zero in the sixth step ST6; an eighth step for comparing and checking whether or not the index BIT is zero, which is having information with respect to the bit number assigned to one sub-band when the mask-to-noise ratio is larger than zero from the sixth step ST6; a ninth step ST8 for repeatedly performing the steps after the fourth step ST4 by increasing the virtual sub-band number N when the checked result index is zero; a tenth step ST10 for computing an effective assignment bit number eadb when the compared and checked result index BIT is not zero; an eleventh step ST11 for performing the ninth step ST9 when the virtual sub-band number N with respect to the effective assignment bit number obtained from the tenth step ST10 is smaller than 27; a twelfth step ST12 for checking whether or not the total assignment possible bit number is larger or/and equal than the effective assignment bit number when the virtual sub-band number N is larger than 27; a first effective assignment bit number operation step ST101 for obtaining a new effective assignment bit number with bit information of a sub-band after obtaining the sub-band having the total virtual noise ratio when the effective assignment bit number is smaller than the total assignment possible bit number as a result of the twelfth step ST12; and a second effective assignment bit number operation step ST102 for obtaining a new effective assignment bit number using bit information of the sub-band after obtaining the sub-band having a largest mask-to-noise ratio in the total virtual sub-band when the effective assignment bit number is larger than the total assignment possible nit number as a result of the twelfth step ST12.

Figure 2:
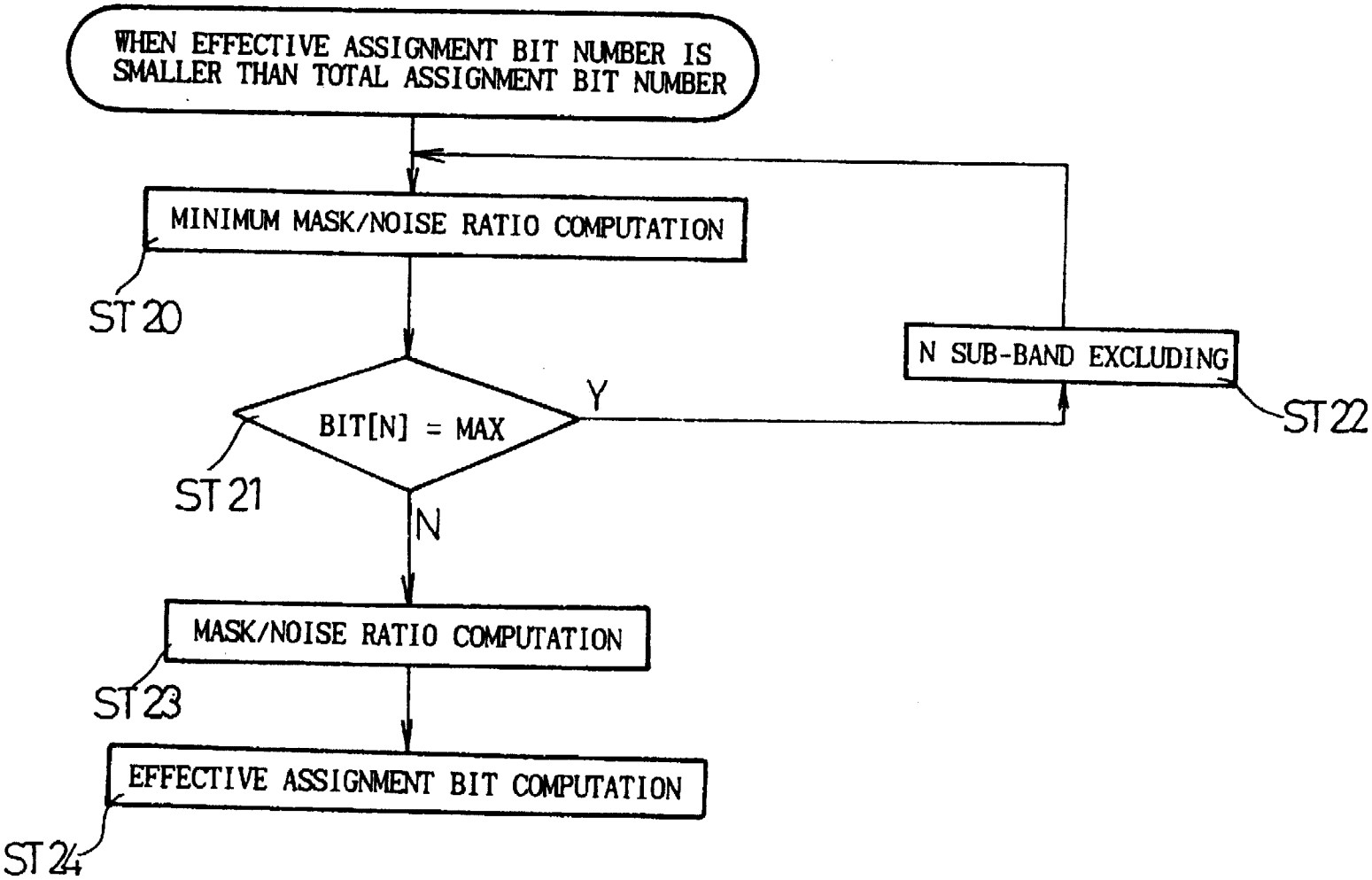
FIG. 2 is a flow chart showing smaller assignment bit number processing which is performed when the effective assignment bit number shown in FIG. 1 is smaller than the total assignment possible bit number.

Referring to FIG. 2, the first effective assignment bit number operation step ST101 includes a first step ST20 for obtaining a minimum mask-to-noise ratio from the sub-band having a total virtual noise ratio; a second step ST21 for checking an index BIT having information with respect to the bit number assigned to one sub-band, that is, whether or not the minimum mask-to-noise ratio is maximum; a third step ST22 for performing the first step ST20 after excluding the virtual sub-band when the minimum mask-to-noise ratio is maximum; a fourth step ST23 for obtaining a new mask-to-noise ratio with respect to the sub-band when the mask-to-noise ratio is not the maximum; and a fifth step ST24 for repeatedly performing the twelfth step ST12 of FIG. 1 by obtaining a new effective assignment bit number by using the mask-to-noise ratio from the fourth step ST23.

Figure 3:
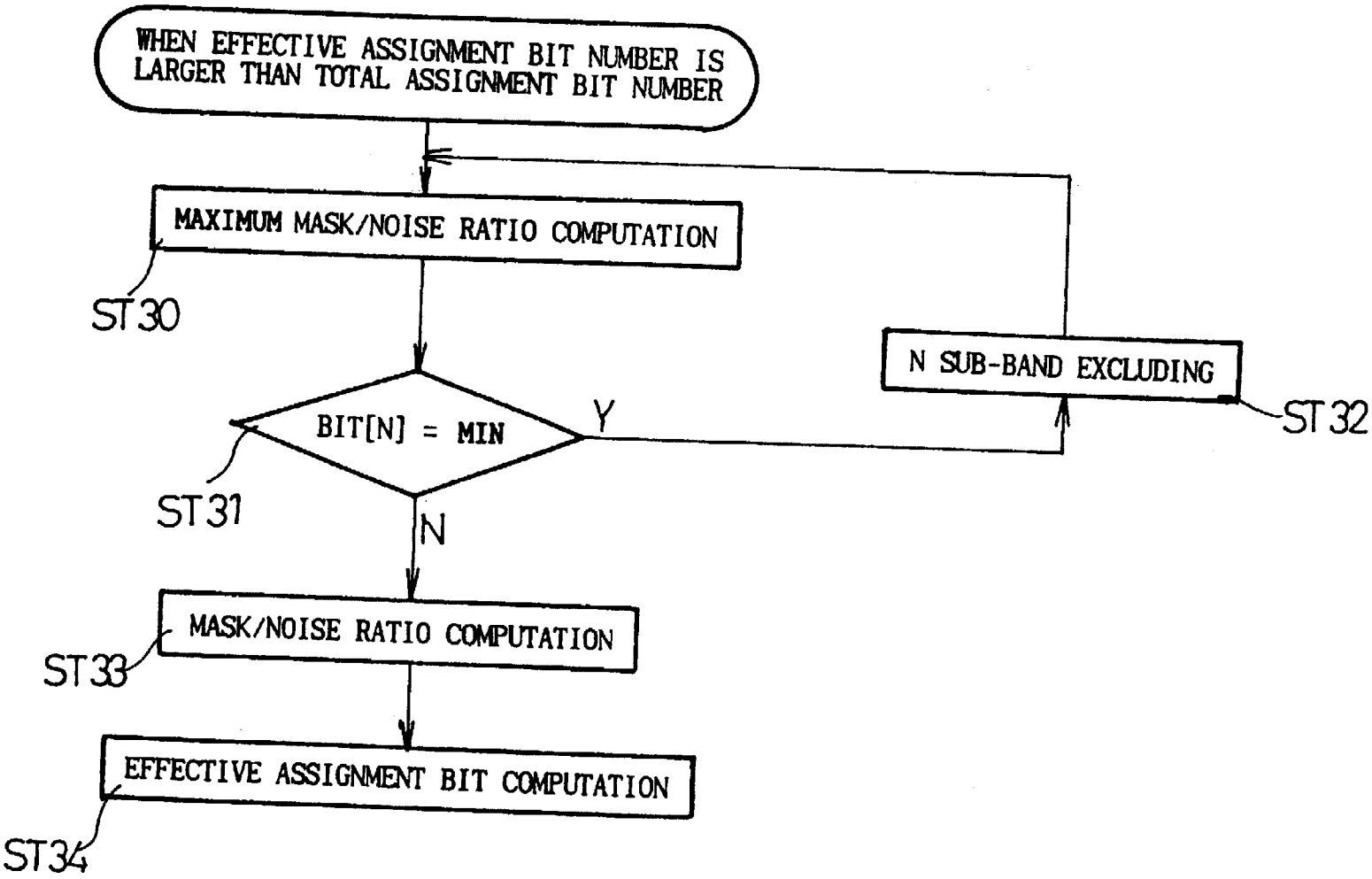
FIG. 3 is a flow chart showing a larger assignment bit number processing which is performed when the effective assignment bit number shown in FIG. 1 is larger than the total assignment possible bit number.

Referring to FIG. 3, the second effective assignment bit number operation step ST102 includes a first step ST30 for obtaining a sub-band having a largest mask-to-noise ratio in the total virtual sub-band, a second step ST31 for checking whether or not the index having information with respect to the bit number assigned to the sub-band and the minimum bit number; a third step ST32 for performing the first step ST30 by excluding the virtual sub-band N when the terms of the second step ST31 is satisfied; a fourth step ST33 for obtaining a new mask-to-noise ratio with respect to the sub-band when the terms of the second step ST31 is not satisfied; and a fifth step ST34 for performing the twelfth step ST12 of FIG. 1 by obtaining a new effective assignment bit number using the mask-to-noise ratio from the fourth step.

The operation of the present invention will now be explained with reference to FIGS. 1 to 3.

To begin with the total assignment possible bit number adb is obtained from the following formula using the psychological acoustic model:

Total assignment possible bit number adb=total bit number cd–header bit bhdr+error correction bit bcrc+bits indicating bit assignment information bbal formula 1

The total assignment possible bit number adb in the above formula 1 changes according to the bit rate and frame size.

The flow chart for obtaining the effective assignment bit number is shown in FIG. 1.

When the output value of the signal-to-mask obtained through the psychological acoustic model is obtained in the first step ST1, the variable length support data region is added thereto in order to effectively use the total bit without decreasing the original function of the support data.

The total assignment possible bit number is obtained through the third step ST3 using the signal-to-mask ratio from the psychological acoustic model and the predetermined variable length support data set and the number of the performing is limited by the number of the sub-band of each channel by togethering the same sub-band of each of the channel in case of the multi-channel mode.

Thereafter the mask-to-noise ratio is obtained using the signal-to-noise ratio SNR and the mask-to-noise ratio is checked to determine whether or not it is larger than zero through the sixth step ST6.

When the mask-to-noise ratio is smaller than zero, one index BIT having information with respect to the bit number assigned to the sub-band is increased and thereafter the steps after the fourth step ST4 is repeatedly performed.

When the mask-to-noise ratio is larger than zero at the sixth step ST6, through the eighth step ST8, whether or not the index BIT having information with respect to the bit number assigned to one sub-band is zero.

When the index BIT having information with respect to the bit number assigned to one sub-band is zero, through the ninth step ST9, the steps after the fourth step ST4 is performed adding 1 to the virtual sub-band number N.

When the index BIT is not zero at the eighth step ST8, the effective assignment bit number eadb is computed through the tenth step ST10 and whether or not the virtual sub-band number N is smaller than 27 is checked therethrough.

When the sub-band number N is smaller than 27, the sub-band number N is increased through the ninth step ST9. When it is larger than 27, whether or not the total assignment possible bit number is larger or/and equal to the effective assignment bit number is checked through the twelfth step ST12.

When the condition of the twelfth step ST12 is satisfied as shown in FIG. 2, the first effective possible bit number is obtained through the first effective possible bit number operation processing ST101 and when the condition of the twelfth step ST12 is not satisfied as shown in FIG. 3, the second effective possible bit number is obtained through the second effective possible bit number operation processing ST102.

The mask-to-noise ratio is obtained through a formula Mask-to-noise ratio MNR=signal-to-noise ratio SNR–Signal-to-mask ratio SMR through the fifth step ST5, in which when the mask-to-noise ratio is larger than zero, the masking effects are secured, so that the bit assignment is performed in order that the mask-to-noise ratio may be over zero at the first sub-band loop according to the present invention. In addition, the maximum 16 bits and the minimum 2 bits per sample are assigned.

The effective assignment bit number eadb is computed through a formula effective assignment bit number eadb= assignment bit number per sample+counted count+ normalization count assignment information bit per band.

The normalized count is bits assigned from the 6 bits to the 18 bits according to the normalization count assignment bit per band. Here, when the bit assignment amount is over 2 per sample, it is available and when the bit assignment amount is zero, the normalization count assignment information bit per band and the normalized count bit are not assignment.

FIG. 2 shows a flow chart of the smaller assignment bit number processing when the effective assignment bit number is smaller than the total assignment possible bit number.

Whether or not the index BIT having information with respect to the bit number assigned to one sub-band after the sub-band having the total virtual noise ratio MNR is obtained is equal to the maximum 16 bits is checked through the step ST20 and the step ST21.

When the condition of the result of the step ST21 is satisfied, the step ST20 is performed excluding the virtual sub-band N.

In addition, when the condition of the result of the step ST21 is not satisfied, a new mask-to-noise ratio with respect to the sub-band is obtained.

When the above-mentioned steps are performed, a new effective assignment bit number having bit information of the changed sub-band is obtained through the step ST24 and the step ST12 shown in FIG. 1 is performed.

In addition, FIG. 3 shows a flow chart of the larger assignment bit number obtaining the second effective assignment bit number when the effective assignment bit number is larger than the second effective assignment bit number.

Here, after the sub-band having the larger mask-to-noise ratio MNR is obtained, whether or not the index BIT having information with respect to bit number assignment to one sub-band and the minimum bits MIN are equal from each other is checked through the steps ST30 and ST31.

When the bit assignment amount is zero, the step ST30 is performed after the bit assignment amount is reduced by one excluding the virtual sub-band N.

In addition, when the condition is not satisfied through the step ST30, a new mask-to-noise ratio is obtained with respect to the then sub-band through the step ST33.

When the above-mentioned steps are performed, a new effective assignment bit number is obtained with bit information of the sub-band and the step ST12 of FIG. 1 is performed.

When the efficiency of the bit assignment is increased and when the support data region of the variable length is used, 100% of the total bit number needed to produce the bit stream of one frame is available, so that high speed processing can be secured, and thus a high-speed bit assignment method for audio signals, usable by various systems using encoding and decoding can be secured thereby.

What is claimed is:

1. A high-speed bit allocation method for an audio signal, the audio signal comprising channels, sub-channels and bits, the method comprising the steps of:

A) computing a total allocable bit number available to each channel using a signal-to-noise ratio from a psychological acoustic model, virtually adding the same frequency sub-bands of the channels, and computing an effective allocable bit number of each of the sub-bands;

B) comparing the total allocable bit number and the effective allocable bit number from step (A); and C) computing a second effective allocable bit number when the effective allocable bit number from step (A) is larger than the total allocable bit number.

2. The method of claim 1, wherein step (A) comprises:

i) computing the total allocable bit number using a variable length data region and the signal-to-noise ratio obtained from the psychological acoustic model;

ii) limiting a performing number, which is equal to the number of sub-bands for each channel, by gathering the same sub-bands of the channels into virtual sub-bands after computing the total allocable bit number;

iii) obtaining a mask-to-noise ratio using the signal-to-noise ratio and checking whether the value of the mask-to-noise is positive;

iv) when the mask-to-noise ratio is negative, repeating the steps after step (ii) by adding 1 to an index having information with respect to a bit number allocated to a virtual sub-band under consideration;

v) when the mask-to-noise ratio is positive in step (iii), checking whether the index is zero;

vi) when the index is zero, performing repeatedly the steps after step (ii) by increasing a virtual sub-band number N of the sub-band under consideration;

vii) when the index is not zero, computing the effective allocable bit number, checking whether the virtual sub-band number is smaller than a predetermined value, and enabling step (vi) to be performed when the virtual sub-band number is less than the predetermined value; and viii) when the virtual sub-band number is larger than the predetermined value in the previous step, checking whether the total allocable bit number is larger or/and equal to the effective allocable bit number.

3. The method of claim 1, wherein step (B) comprises:

i) checking whether an index having information with respect to a bit number allocated to one sub-band of the sub-band with a minimum mask-to-noise ratio is equal to a maximum 16 bits;

ii) when the requirements of step (i) are met, excluding virtual sub-band N and re-performing step (i);

iii) when the requirements of step (i) are not met, obtaining a new mask-to-noise ratio with respect to the sub-band; and iv) computing a new effective allocable bit number with changed bit information of the sub-band that is obtained as a result of step (iii).

4. The method of claim 1, wherein step (C) comprises:

i) computing a virtual sub-band including a largest mask-to-noise ratio;

ii) skipping the sub-band when an index number of the sub-band is zero;

iii) reducing an allocable bit number of a sub-band that has a non-zero index number by one bit; and iv) computing a new effective allocable bit number with changed bit information of a sub-band that is obtained from step (iii).

5. The method of claim 2, wherein mask-to-noise ratio is obtained by subtracting a signal-to-mask ratio from a signal-to-noise ratio.

6. The method of claim 2, wherein the effective allocable bit number is computed by the following formula:

effective allocable bit number=allocable bit number per sample+normalized count+normalization count allocation information bits per band.

7. The method of claim 1, wherein the number of sub-bands per channel is 27.

8. The method of claim 6, wherein the normalized count is allocated from 6 bits to 18 bits based upon the normalization count allocation information bits per band.

9. A high-speed bit allocation method for an audio signal, the audio signal comprising channels, sub-channels and bits, the method comprising the steps of:

A) computing a total allocable bit number available to each channel using a signal-to-noise ratio from a psychological acoustic model, virtually adding the same frequency sub-bands of the channels, and computing an effective allocable bit number of each of the sub-bands;

B) comparing the total allocable bit number and the effective allocable bit number from step (A); and C) computing a second effective allocable bit number when the effective allocable bit number from step (A) is larger than the total allocable bit number;

wherein step (A) comprises the following steps:

i) computing the total allocable bit number using a variable length data region and the signal-to-noise ratio obtained from the psychological acoustic model;

ii) limiting a performing number, which is equal to the number of sub-bands for each channel, by gathering the same sub-bands of the channels into virtual sub-bands after computing the total allocable bit number;

iii) obtaining a mask-to-noise ratio using the signal-to-noise ratio and checking whether the value of the mask-to-noise is positive;

iv) when the mask-to-noise ratio is negative, repeating the steps after step (ii) by adding 1 to an index having information with respect to a bit number allocated to a virtual sub-band under consideration;

v) when the mask-to-noise ratio is positive in step (iii), checking whether the index is zero;

vi) when the index is zero, performing repeatedly the steps after step (ii) by increasing a virtual sub-band number N of the sub-band under consideration;

vii) when the index is not zero, computing the effective allocable bit number, checking whether the virtual sub-band number is smaller than a predetermined value, and enabling step (vi) to be performed when the virtual sub-band number is less than the predetermined value; and viii) when the virtual sub-band number is larger than the predetermined value in the previous step, checking whether the total allocable bit number is larger or/and equal to the effective allocable bit number.

10. The method of claim 9, wherein step (B) comprises:

ix) checking whether an index having information with respect to a bit number allocated to one sub-band of the sub-band with a minimum mask-to-noise ratio is equal to a maximum 16 bits;

x) when the requirements of step (ix) are met, excluding virtual sub-band N and re-performing step (ix);

xi) when the requirements of step (ix) are not met, obtaining a new mask-to-noise ratio with respect to the sub-band; and xii) computing a new effective allocable bit number with changed bit information of the sub-band that is obtained as a result of step (xi).

11. The method of claim 9, wherein the third step comprises:

xiii) computing a virtual sub-band including a largest mask-to-noise ratio;

xiv) skipping the sub-band when an index number of the sub-band is zero;

xv) reducing an allocable bit number of a sub-band that has a non-zero index number by one bit; and xvi) computing a new effective allocable bit number with changed bit information of a sub-band that is obtained from step (xv).

12. The method of claim 10, wherein mask-to-noise ratio is obtained by subtracting a signal-to-mask ratio from a signal-to-noise ratio.

13. The method of claim 10, wherein the effective allocable bit number is computed by the following formula:

effective allocable bit number=allocable bit number per sample+normalized count+normalization count allocation information bits per band.

14. The method of claim 9, wherein the number of sub-bands per channel is 27.

15. The method of claim 14, wherein the normalized count is allocated from 6 bits to 18 bits based upon the normalization count allocation information bits per band.

* * * * *